US005605416A

United States Patent [19]

Roach

[11] Patent Number: 5,605,416

[45] Date of Patent: Feb. 25, 1997

[54] WATER, SEDIMENT AND EROSION CONTROL APPARATUS AND METHODS

[76] Inventor: Gary W. Roach, P.O. Box 1632, Midwest City, Okla. 73110

[21] Appl. No.: 410,720

[22] Filed: Mar. 27, 1995

[51] Int. Cl.[6] ..... E02B 3/00

[52] U.S. Cl. ..... 405/21; 405/32

[58] Field of Search ..... 405/16, 21, 29, 405/30, 31, 32, 33, 34, 35

[56] References Cited

U.S. PATENT DOCUMENTS

| | | | |
|---|---|---|---|
| 321,593 | 7/1885 | Fry . | |
| 421,631 | 2/1890 | Sutherland . | |
| 716,572 | 12/1902 | Neale . | |
| 752,637 | 2/1904 | Mankedick . | |
| 919,788 | 4/1909 | Smith . | |
| 929,728 | 8/1909 | Taylor . | |
| 1,039,579 | 9/1912 | Neames . | |
| 1,230,608 | 6/1917 | Sheldon . | |
| 1,578,138 | 3/1926 | Kirk . | |
| 1,584,766 | 5/1926 | Gordon et al. . | |
| 2,055,150 | 9/1936 | Heskett | 61/3 |
| 2,097,342 | 10/1937 | Rehfeld | 61/5 |
| 2,162,499 | 6/1939 | Borhek | 61/46 |
| 2,745,768 | 5/1956 | Karch | 61/1 |
| 3,309,876 | 3/1967 | Potter | 61/3 |
| 3,568,453 | 3/1971 | Ziegenmeyer | 61/63 |
| 3,720,067 | 3/1973 | Aubert | 61/46 |
| 3,786,638 | 1/1974 | Fish | 61/30 |
| 3,855,800 | 12/1974 | Ganzinotti | 61/29 |
| 4,031,676 | 6/1977 | Dally | 52/102 |
| 4,136,995 | 1/1979 | Fish | 405/115 |
| 4,541,751 | 9/1985 | Larsen | 405/15 |
| 4,610,568 | 9/1986 | Koerner | 405/19 |
| 4,668,123 | 5/1987 | Larsen | 405/15 |
| 4,690,585 | 9/1987 | Holmberg | 405/19 |
| 4,692,060 | 9/1987 | Jackson, III | 405/115 |
| 4,729,691 | 3/1988 | Sample | 405/21 |
| 4,765,775 | 8/1988 | Kroger | 405/52 |
| 4,787,776 | 11/1988 | Brady et al. | 405/270 |
| 4,921,373 | 5/1990 | Coffey | 405/115 |
| 4,976,063 | 12/1990 | Young | 47/33 |
| 5,039,250 | 8/1991 | Janz | 405/15 |
| 5,040,919 | 8/1991 | Hendrix | 405/415 |
| 5,114,270 | 5/1992 | Riddle | 405/32 X |
| 5,157,867 | 10/1992 | Fritch | 47/33 |
| 5,158,395 | 10/1992 | Holmberg | 405/21 |
| 5,176,468 | 1/1993 | Poole | 405/21 X |
| 5,236,281 | 8/1993 | Middleton | 405/114 |
| 5,429,450 | 7/1995 | Meidinger | 405/33 X |

FOREIGN PATENT DOCUMENTS

| | | |
|---|---|---|
| 3331563 | 3/1985 | Germany . |
| 62-21914 | 1/1987 | Japan . |
| 0036319 | 2/1991 | Japan . |
| 1491938 | 7/1989 | U.S.S.R. . |
| 1730338 | 4/1992 | U.S.S.R. . |
| 715126 | 9/1954 | United Kingdom . |

OTHER PUBLICATIONS

Precast Tetrahedrons, Mar. 1934.

"*Shoreline Levee Dam Protection System*," MaxAnn Inc. advertising brochure (Aug. 1987).

"*Storm Water Management For Construction Activities—Developing Pollution Prevention Plans And Best Management Practices*," United States Environmental Protection Agency, Sep. 1992, ch. 3, pp. 3–1 to 3–72.

*Primary Examiner*—William P. Neuder

*Attorney, Agent, or Firm*—Dougherty, Hessin, Beavers & Gilbert

[57] ABSTRACT

The water, sediment and erosion control apparatus of the present invention includes a water-permeable foam barrier extending generally longitudinal. The barrier has an upstream surface and a downstream surface. The apparatus also includes an apron extending laterally away from at least one surface of the barrier. The apparatus is reconfigurable for different applications by rotating the barrier relative to the apron. The method of the present invention comprises providing a reusable apparatus having an angled barrier and a protective apron, and anchoring the apparatus generally perpendicular to a natural flow of water, such that the water carrying the sediment is slowed and sediment is deposited upstream of the apparatus.

27 Claims, 3 Drawing Sheets

WATER, SEDIMENT AND EROSION CONTROL APPARATUS AND METHODS

BACKGROUND OF THE INVENTION

1. Field of the Invention

This invention relates generally to hydrogeology and more particularly, but not by way of limitation, to water, sediment and erosion control apparatus and methods.

2. Description of the Prior Art

Construction often disturbs trees, grasses, bushes and other elements which naturally control run-off water, sediment and erosion. Typically, the bare earth is exposed in a construction site which, if no controls are implemented, significant erosion and other water damage can occur. In fact, the United States Environmental Protection Agency has issued regulations requiring contractors whose construction operations disturb five or more acres of land to implement erosion and sediment controls. See Federal Register, vol. 57, no. 175, p. 41,217, Sep. 9, 1992.

One type of sediment and erosion control device which is often used is hay or straw bales. However, hay bales are seldom satisfactory. First, they are difficult to install. The weight and associated factors of hay bales make installation a labor intense task. Second, long wooden or steel stakes must be used to hold the bales in place. These are expensive and difficult to install and remove. Third, quality control for hay or straw bales is very seldom available, resulting in a poor quality material often being used. Fourth, hay bales placed in a barrier position cannot be joined together to stop water penetration, resulting in erosion between and underneath the bales and eventually failure of the barrier. If water does not flow under or penetrate between the bales, it will often flow over the top causing erosion of the soil directly behind and beneath the bales and eventually resulting in failure. Additionally, hay or straw bales become soil laden very quickly and cannot be reused. The wire or string holding the hay together often deteriorates and breaks. Finally, hay bales are not readily available in some areas and, due to their weight and bulkiness, cannot be shipped to these areas in a cost-efficient manner.

Another type of erosion and sediment control device is a silt fence. A silt fence is a permeable barrier made of filter fabric buried at the bottom, stretched and supported by posts. However, silt fences generally do not have the structural strength to collect soil and sediment. Furthermore, because silt fences are not designed to withstand high heads, the general use of silt fences is limited. Furthermore, silt fences require a great amount of maintenance.

Many other devices and methods have been and are currently being used: check dams, detention basins, temporary and permanent earth diversions, rock or cement-lined waterways and outlets, mulching, surface roughening and temporary seeding. See Storm Water Management For Construction Activities—Developing Pollution Prevention Plans And Best Management Practices, United States Environmental Protection Agency, chapter 3, September 1992. These devices and methods suffer similar problems including a lack of effectiveness, intensive labor requirements and expense.

Another application where it is necessary to control water involves flood situations. Sand-filled bags are often used to build a barrier wall, for example, surrounding a house or lining a river bank. However, sand bags are heavy and do not have great lateral strength to support a high wall of water. Furthermore, due to short warning times and the labor intensive nature of preparing a sand bag barrier, often there is simply not enough time to build a sand bag barrier prior to flooding.

Thus, there is a need for improved water, sediment and erosion control apparatus and methods which are effective, easily and quickly installed and removed, lightweight, inexpensive, durable and reusable.

SUMMARY OF THE INVENTION

The present invention provides improved water, sediment and erosion control apparatus and methods which meet the need described above and overcome the shortcomings of the prior art. This invention provides an apparatus for controlling water, sediment and erosion comprising a water-permeable foam barrier extending generally longitudinally, the barrier having an upstream surface and a downstream surface, and an apron extending laterally away from at least one of the surfaces of the barrier.

This invention also provides an apparatus for controlling water, sediment and soil erosion comprising a longitudinally extending barrier having an upstream surface and a downstream surface, a protective apron disposed about the barrier and having an approach apron portion extending in a lateral direction from the upstream surface and an exit apron portion extending in a lateral direction from the downstream surface, and a longitudinal attaching means for providing an axis about which the barrier is reconfigurable by rotating the barrier relative to the apron.

Further, this invention provides a method of controlling water, sediment and soil erosion comprising providing a reusable apparatus having an angled barrier and a protective apron, and anchoring the apparatus generally perpendicular to a natural flow of the water carrying the sediment such that the water carrying the sediment is slowed, allowing sediment to be deposited upstream of the apparatus.

Additionally, this invention provides a method of controlling water comprising providing an apparatus having an angled barrier, a protective apron and means for preventing water from passing through the barrier, and anchoring the apparatus generally perpendicular to a flow of water, whereby water is prevented from passing through the barrier and must reach a higher level to flow over the barrier.

It is therefore a general object of the present invention to provide improved water, sediment and erosion control apparatus and methods which are effective, easily and quickly installed and removed, lightweight, inexpensive, durable and reusable. Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
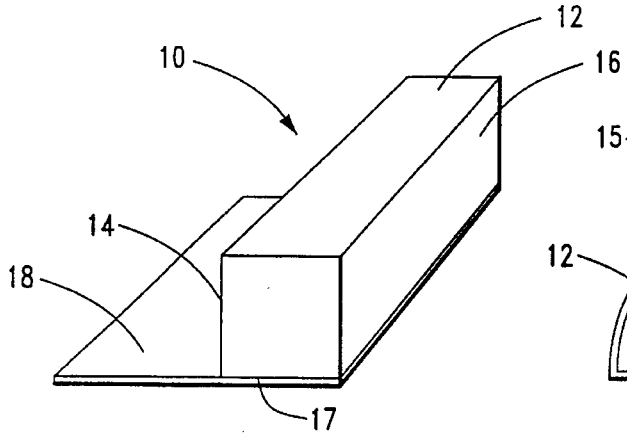
FIG. 1A is a perspective view of the water, sediment and erosion control apparatus of the present invention.

Referring to the drawings, presently preferred embodiments of the invention and their operation are illustrated. Like reference numerals refer to like parts throughout the drawings and this description.

Figure 1B:
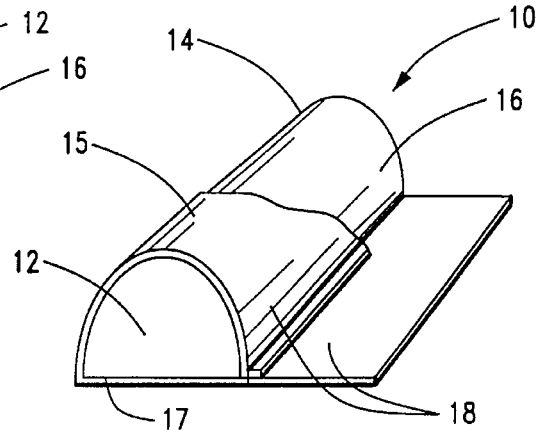
FIG. 1B is a perspective view of another embodiment of the apparatus.
Figure 1C:
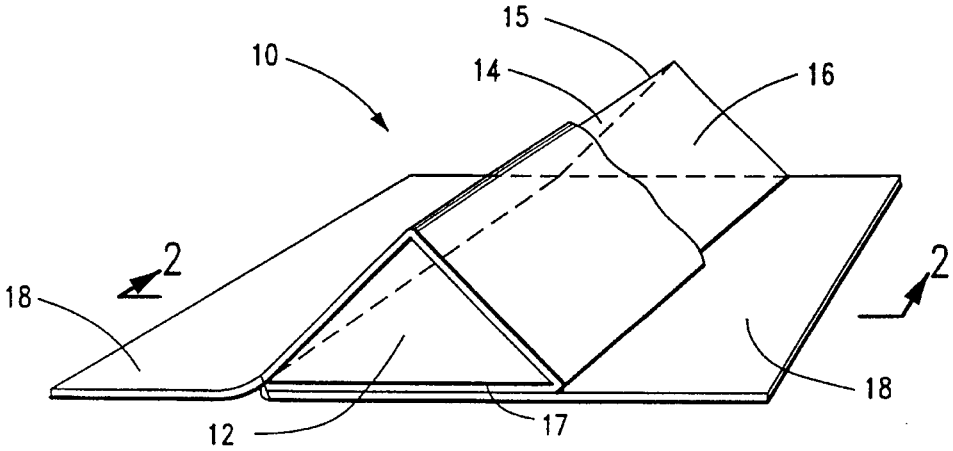
FIG. 1C is a perspective view of yet another embodiment of the apparatus.

Referring to FIGS. 1A, 1B and 1C, an apparatus for controlling water, sediment and soil erosion is designated generally by the numeral 10. Apparatus 10 includes barrier 12 which extends generally in a longitudinal direction. Barrier 12 has first surface 14, second surface 16, third surface 17 and apex 15. Barrier 12 can be any shape, formed of any material, and can have any dimensions. Apparatus 10 also includes apron 18 which extends laterally away from at least one surface of barrier 12; however, it is not necessary for apron 18 to be perpendicular to a surface of barrier 12. Apron 18 can be formed of any number of pieces of any material.

Figure 2:
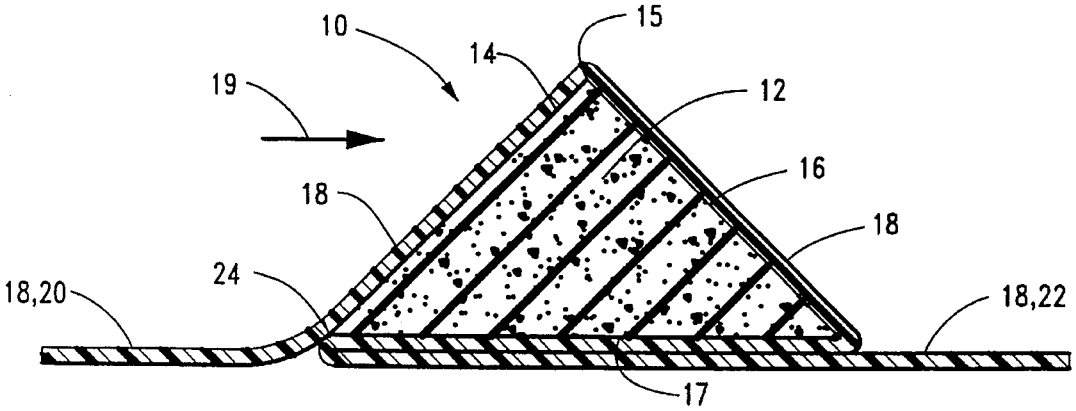
FIG. 2 is a sectional view of the presently preferred embodiment of the apparatus taken along lines 2—2 in FIG. 1C.

Referring to FIG. 2, a presently preferred mode of the invention is shown. Barrier 12 has a 90° isosceles triangle shaped cross section and is formed of a water-permeable polyurethane foam having a density of about 1.0 pound per cubic foot. The dimensions of barrier 12 can be varied in order to accommodate different applications. The direction of the flow of the water is indicated by flow arrow 19.

The term foam as used herein includes any absorbent, light-weight material including urethane foams and synthetic rubbers. Polyurethane foam is a material which is ideally suited for barrier 12. First, it is lightweight which keeps installation costs, including labor, and shipping costs at a minimum. Second, it is durable and thus reusable. Third, polyurethane foam is porous and absorbs water, which aids in keeping apparatus 10 stationary. Furthermore, polyurethane foam's porous characteristics enable its volume to be significantly reduced, such that apparatus 10 may be vacuum packed, shipped and handled in a more efficient and convenient manner.

Additionally, polyurethane foam is flexible and yet resilient. Thus, curved dikes may be formed. Also, if necessary, a service vehicle can drive over apparatus 10 without causing structural damage. Moreover, the density and flexible characteristics of foam provide less danger to automobiles that inadvertently leave the roadway and collide with apparatus 10. Finally, polyurethane foam is inexpensive.

In the preferred mode, as is shown in FIG. 2, apron 18 is disposed about barrier 12, including first surface 14, second surface 16 and third surface 17. Apron 18 also extends laterally from first surface 14 to form approach apron portion 20 and extends laterally from second surface 16 to form exit apron portion 22. Ideally, apron 18, including approach apron portion 20 and exit apron portion 22, is formed from a single piece of water-permeable geotextile material such as woven or non-woven polypropylene or nylon. Other materials which are reusable and durable when exposed to water and sunlight may also be used.

Barrier 12 is attached to apron 18 by attaching means 24. Attaching means 24 includes all means for attaching and equivalents thereof, including but not limited to, sewing, melting, gluing, binding, clamping, etc. However, as used herein "attached" does not require physical connection. In fact, the present best mode of the attaching means is longitudinally sewing a seam in apron 22 using nylon or polyester thread, such that a longitudinal enclosure with open ends is created. Barrier 12 can then be positioned in the enclosure.

Figure 3:
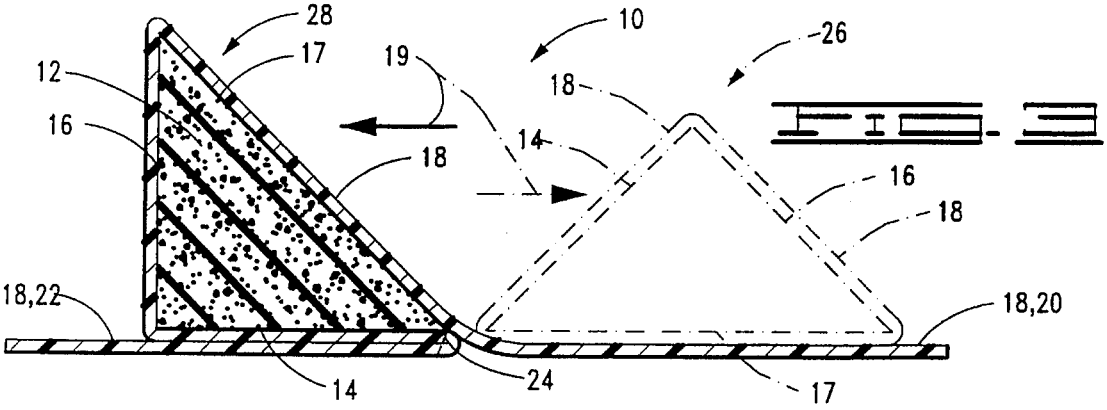
FIG. 3 is a sectional view showing the reconfigurable aspects of the apparatus.

Referring to FIG. 3, a reconfigurable aspect of apparatus 10 is shown. Apparatus 10 is reconfigurable by rotating barrier 12 about a longitudinal axis such as along the axis of attaching means 24. As FIG. 3 illustrates, barrier 12 is selectively pivotable between a first position indicated by numeral 26 and a second position indicated by numeral 28 about a longitudinal axis formed by seam 24. Accordingly, the present invention can be reconfigured for different applications as will be later explained in detail.

In both the first position designated by numeral 26 and the second position designated by numeral 28, seam 24 remains adjacent the surface in the upstream position and adjacent the surface in the base position as is shown by flow arrows 19. Thus, in either configuration, the weight of the water acting upon the surface in the upstream position keeps the surface in the base position generally parallel to the ground, thus preventing inadvertent reconfiguration of apparatus 10 during use.

As used herein, upstream position designates the surface which generally faces the natural flow of the water. Base position designates the surface which is generally parallel to or abuts the ground. Downstream position designates the surface which generally does not face the natural flow of water.

Upon reconfiguration of apparatus 10, the surfaces, i.e., first surface 14, second surface 16, and third surface 17, change positions. For example, in the first position indicated by numeral 26, first surface 14 is in the upstream position, second surface 16 is in the downstream position and third surface 17 is in the base position. However, upon reconfiguration of apparatus 10 to the second position indicated by numeral 28, first surface 14 is in the base position, second surface 16 is in the downstream position and third surface 17 is in the upstream position.

Figure 4:
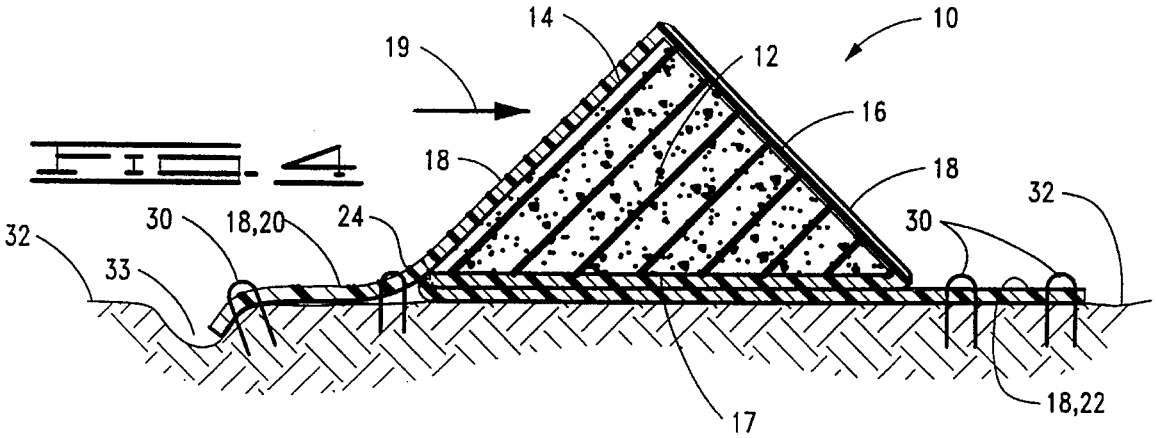
FIG. 4 is a sectional view showing the apparatus anchored to a ground surface.

Referring to FIG. 4, the present invention also includes means for anchoring apparatus 10 to a ground surface 32. Means for anchoring 30 may comprise any known means and equivalents thereof, including without limitation, standard staples, stakes, etc. Standard U-shaped metal no. 11 gage staples are preferred. Ideally, the leading edge of approach apron portion 20 is anchored in shallow trench 33, then trench 33 is filled with dirt in order to prevent water and silt from flowing under approach apron portion 20 and apparatus 10.

Figure 5:
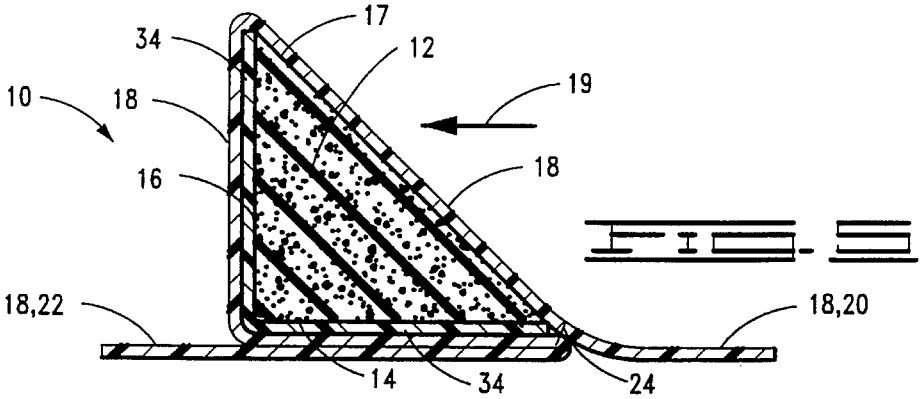
FIG. 5 is a sectional view of the apparatus showing a water-impermeable member.

Referring to FIG. 5 apparatus 10 can also include means for preventing fluid from passing through barrier 12. Means for preventing may include water-impermeable member 34, such as plastic sheeting, disposed between apron 18 and the surface in the downstream position. Water-impermeable member 34 can completely surround barrier 12. As shown in FIG. 5, water-impermeable member 34 ideally does not cover the surface of barrier 12 which is in the upstream position (i.e., third surface 17 in the configuration shown in FIG. 5) so that the water can be absorbed into barrier 12, whereby the additional weight of the water helps to keep apparatus 10 stationary.

Figure 6:
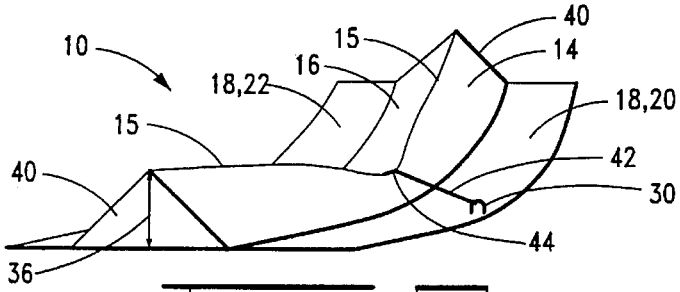
FIG. 6 is a perspective view showing means for reducing the height of the barrier.

Referring to FIG. 6, apparatus 10 of the present invention may also comprise means for reducing height 36 of some point of barrier 12 to a lower elevation than base portions of ends 40. Means 42 can include any possible means for reducing height 36 of some point of barrier 12 including a piece of rope pulled tight and attached upstream and downstream of barrier 12. This obviously will allow water to flow over low point 44 of barrier 12 at a predetermined point or points as will be later explained in detail rather than, for example, eroding around ends 40.

Figure 7:
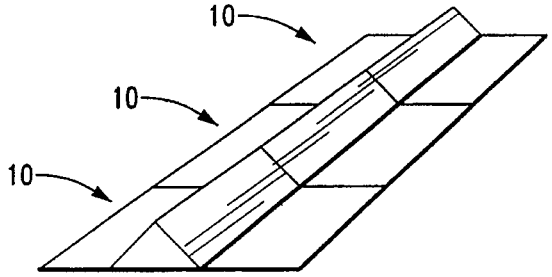
FIG. 7 is a perspective view showing a plurality of apparatus positioned end-to-end to form a continuous dike.

Apparatus 10 can be used in several different applications. In one such application, the present invention can be used to prevent erosion, soil loss and large sediment deposits in unwanted areas. For example, in this application apparatus 10 can be used in an open drainage ditch, along an exposed earth slope or in any other area where erosion and sediment problems are likely. In this application, apparatus 10 is anchored generally perpendicular to a natural flow of the water. As shown in FIG. 7, multiple apparatus 10 can be positioned end-to-end in a modular fashion in order to form a continuous dike of the desired length. Apparatus 10 can be interlocked by slightly sliding barrier 12 of each apparatus 10 relative to apron 18 prior to forming the continuous dike or by providing an apron 18 which is slightly longer than barrier 12.

The water, which carries sediment, is slowed by apparatus 10, forming a pool of water upstream of apparatus 10. This allows sediment to be deposited. Some of the water is absorbed into the ground upstream of barrier 12, some passes through apron 18 and barrier 12, and some may flow over apparatus 10 depending on the water flow rate.

In this application, apron 18 and barrier 12 are ideally formed of permeable materials which allow some water to flow through apron 18 and barrier 12, leaving sediment upstream of apparatus 10. Permeable materials also allow water to be absorbed such that the weight of apparatus 10, and particularly of barrier 12, is increased. The additional weight helps to keep apparatus 10 stationary, even in areas of heavy flow.

In order to control the location of where the water overflows and to prevent erosion around ends 40 of apparatus 10, some predetermined point 44 along apex 15 should be lower in elevation than the base portion of each end 40 of apparatus 10, as is shown in FIG. 6. Thus, the water will flow over low point 44 of apex 15 at the desired location rather than around an end 40.

There are many different methods of creating low point 44. First, often the natural curvature of an open drainage ditch will provide low point 44 near the center of apparatus 10. Second, an apparatus 10 with a shorter height 36 can be used in one or more places along the chain of apparatus 10 forming the dike. Finally, since barrier 12 in a best mode is flexible, any number of previously described means 42 can be used to depress barrier 12 and create low point 44.

In this application to prevent erosion, soil loss and large sediment deposits in unwanted areas, apron 18 serves multiple functions. First, apron 18 reduces erosion downstream of apparatus 10 by providing a protective layer between the ground surface 32 and the water which flows over apparatus 10. Second, apron 18 prevents water from flowing and eroding under apparatus 10. Third, apron 18 provides a protective layer around barrier 12. Finally, apron 18 and especially approach apron portion 20 and exit apron portion 22, along with staples 30 (FIG. 4), provide a convenient means for anchoring apparatus 10 to ground surface 32.

In this application the fact that the surfaces which are in the upstream and downstream positions are angled is also important. An angled surface in the upstream position causes a downward force on apparatus 10 when water is pooled upstream of apparatus 10. This downward force helps to keep apparatus 10 stationary even during heavy water flows. An angled surface in the downstream position reduces the velocity and energy of the water which flows over apparatus 10, thus reducing erosion downstream of apparatus 10.

Figure 8:
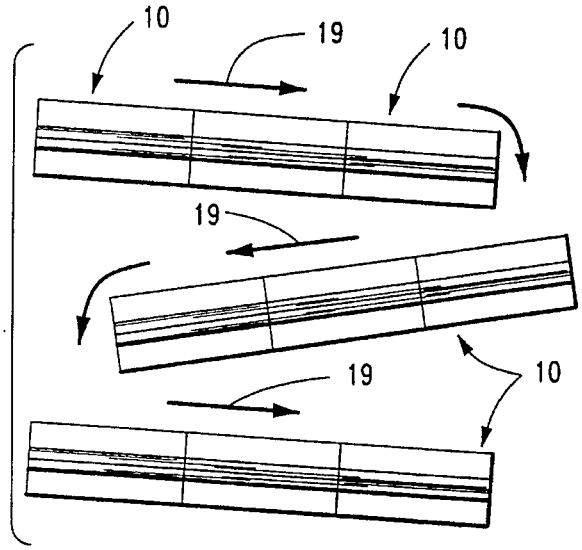
FIG. 8 is a plan view showing an alternate positioning of the apparatus to control the flow of water.

As will be understood by one skilled in the art, apparatus 10 can be modularly positioned in any number of ways. In this application, apparatus 10 will most commonly be positioned with end 40 of one apparatus 10 abutting end 40 of another apparatus 10 as shown in FIG. 7 to form a continuous dike of desired length which is positioned generally perpendicular to the flow of water. However, as shown in FIG. 8, apparatus 10 can be positioned to control, divert and slow the flow of water rather than to create a pool of water. Further, if, as in the best mode, barrier 12 is formed of a flexible material such as polyurethane foam, a modular dike formed by apparatus 10 is not limited to a linear shape.

In other applications, apparatus 10 can be reconfigured and adapted to meet different conditions. For example, where apparatus 10 is positioned adjacent a practically non-erodible surface such as a roadway section or a drop inlet, there is less need for a surface in the downstream position to be angled and for exit apron portion 22 to exist. Accordingly, if barrier 12 has a 90° isosceles triangle cross section as in the best mode, apparatus 10 can be reconfigured such that the 90° angle is adjacent the non-erodible surface and opposite the surface in the upstream position. In this configuration, apparatus 10 forms the highest dike due to the geometric characteristics of a 90° isosceles triangle as is apparent in FIG. 3.

Figure 9:
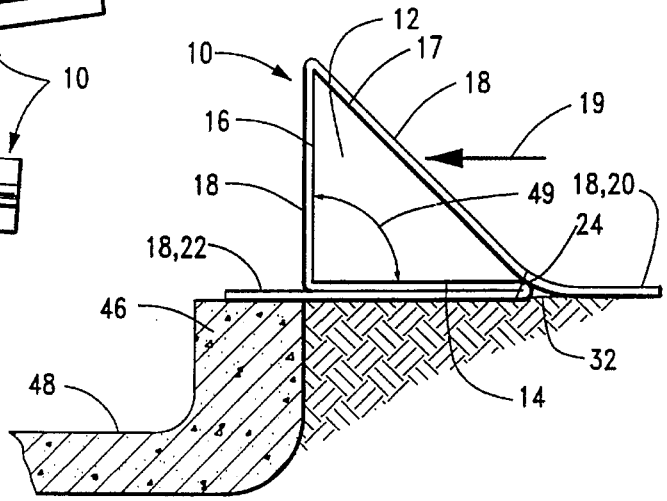
FIG. 9 is a partial sectional view of the apparatus installed adjacent a curbed roadway section.

FIG. 9 shows this configuration installed adjacent a roadway section, such as a new residential or commercial construction area where roadway 48 has been paved, bordered by a cement curb 46, and the construction area has been cleared leaving ground surface 32 exposed. In this application, 90° angle 49 has been oriented adjacent curb 46 and opposite the surface in the upstream position (i.e., third surface 17 of barrier 12 in the configuration shown in FIG. 9). Silt and sediment accumulate upstream of apparatus 10, thus preventing erosion upstream of apparatus 10 and the accumulation of sediment in roadway 48.

Figure 10:
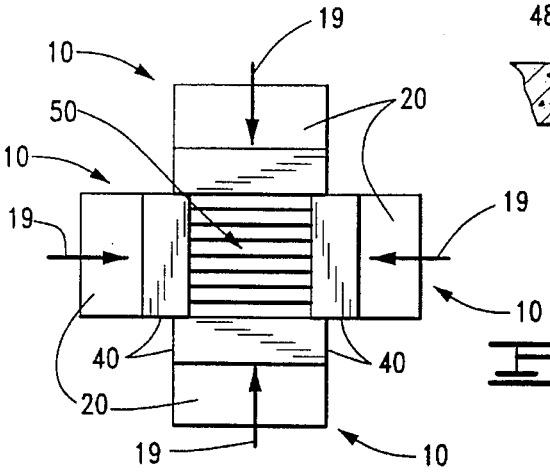
FIG. 10 is a plan view of the apparatus installed in a drop-inlet application.

FIG. 10 shows the drop inlet application. Drop inlet 50 is a type of storm water drain, typically a grate surrounded by a cement foundation at ground level, which diverts flowing water to another location via underground conduits. In this application, multiple apparatus 10 surround drop inlet 50. Apparatus 10 are configured similar to the curb application: with the 90° angle adjacent drop inlet 50 and opposite the surface in the upstream position (i.e., third surface 17 of barrier 12 in the configuration shown in FIG. 10). This configuration not only provides the highest dike around drop inlet 50 but also enables multiple apparatus 10 to be perpendicularly abutted without leaving a gap in the dike. Water is pooled around the dike, allowing sediment to be deposited such that water which flows over the dike contains less sediment.

Figure 11:
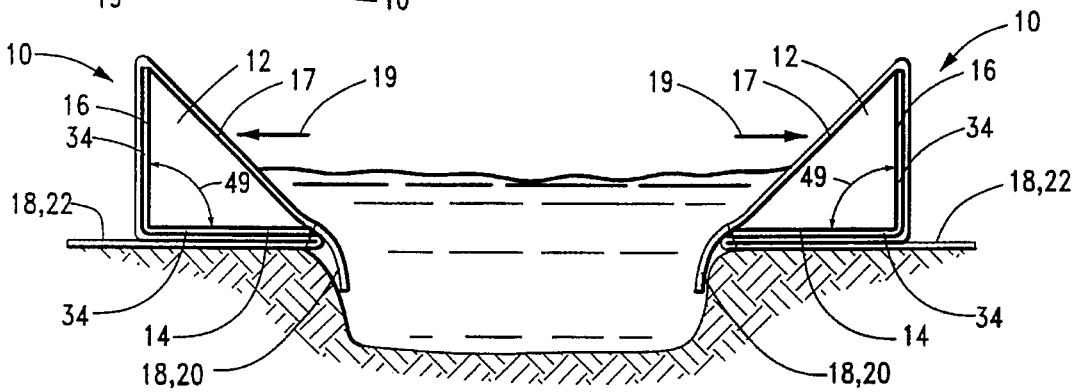
FIG. 11 is a partial sectional view of the apparatus installed in a flood control application.

The present invention may also be used to control flood waters as is shown in FIG. 11. In this application, the goal is to keep water from passing through and over apparatus 10. Water is prevented from passing through apparatus 10 by any means, such as water-impermeable member 34 disposed between apron 18 and a surface of barrier 12. In a best mode, a water-impermeable member 34 such as plastic sheeting is disposed around barrier 12 except for the surface in the upstream position (i.e., third surface 17 as shown in FIG. 11). Leaving upstream or third surface 17 uncovered allows rising water to be absorbed by barrier 12, adding additional weight which helps to keep apparatus 10 stationary.

In a flood control application, apparatus 10 is configured similar to the roadway :section and drop inlet applications, that is, in a best mode, with 90° angle 49 opposite the surface in the upstream position. In a flood control application, many apparatus 10 can be abutted end-to-end to form a continuous dike along a river bank as shown in FIG. 11. Apparatus 10 can also be used to surround a house, structure or any other area in which protection from flood waters is desired. In flood applications, apparatus 10 is superior to prior art devices such as sandbags due to the speed in which a continuous dike can be formed from apparatus 10 and due to the superior strength and effectiveness of the dike.

The present invention encompasses many other applications where it is desirable to control water, sediment and erosion including, without limitation, snow fences, farming applications, beach erosion, etc.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance and steps can be made those skilled in the art, which changes are encompassed within the scope and spirit of the present invention as defined by the appended claims.

What is claimed is:

1. An apparatus for controlling water, sediment and soil erosion comprising:

a water-permeable foam barrier extending generally longitudinally, said barrier having an upstream surface and a downstream surface; and an apron extending laterally away from at least one of said surfaces of said barrier, said barrier attached to said apron by attaching means wherein said barrier is reconfigurable by rotating said barrier about a longitudinal axis of said attaching means.

2. The apparatus of claim 1 wherein said barrier includes a triangular-shaped cross section.

3. The apparatus of claim 2 wherein said upstream surface and said downstream surface form an approximate 90° angle at an apex of said barrier.

4. The apparatus of claim 1 wherein said barrier further comprises a base surface, said base surface forming an approximate 90° angle with said downstream surface.

5. The apparatus of claim 1 wherein said apron is disposed about said barrier.

6. The apparatus of claim 1 wherein said apron extends laterally away from both said upstream surface and away from said downstream surface of said barrier.

7. The apparatus of claim 1 wherein said apron is formed from a single piece of water-permeable material.

8. The apparatus of claim 1 further comprising means for anchoring the apparatus to a ground surface.

9. An apparatus for controlling water, sediment and soil erosion comprising:

a longitudinally extending barrier having an upstream surface and a downstream surface;

a protective apron disposed about said barrier, said protective apron having an approach apron portion extending in a lateral direction from said upstream surface and an exit apron portion extending in a lateral direction from said downstream surface; and a longitudinal attaching means for providing an axis about which said barrier is reconfigurable by rotating said barrier relative to said apron.

10. The apparatus of claim 9 wherein said barrier includes a triangular-shaped cross section.

11. The apparatus of claim 10 wherein said upstream surface and said downstream surface form an approximate 90° angle at an apex of said barrier.

12. The apparatus of claim 9 wherein said barrier further comprises a base, said base forming an approximate 90° angle with said downstream surface.

13. The apparatus of claim 9 wherein said barrier is formed of a water-permeable foam material.

14. The apparatus of claim 9 wherein said apron is formed from a single piece of water-permeable material.

15. The apparatus of claim 9 further comprising means for anchoring the apparatus to a ground surface.

16. The apparatus of claim 9 wherein said attaching means includes a seam about which said barrier is selectively pivotable between first and second positions.

17. A method of controlling water, sediment and soil erosion comprising:

providing a reusable, collapsible apparatus having a barrier and a protective apron, said barrier comprising an angled upstream surface shaped such that the water carrying the sediment exerts a force on said barrier perpendicular to a ground surface; and anchoring the apparatus to said ground surface generally perpendicular to a natural flow of the water carrying the sediment, such that the water carrying the sediment is slowed, allowing sediment to be deposited upstream of the apparatus.

18. The method of claim 17 further comprising:

providing the barrier with a 90° triangular cross section; and orienting the barrier relative to the protective apron such that the 90° angle of the barrier is adjacent a drop inlet, whereby each apparatus may be perpendicularly abutted to other apparatus such that the abutted apparatus form a dike around the drop inlet to reduce the amount of sediment which enters the drop inlet.

19. A method of controlling water comprising:

providing an apparatus having an angled barrier, a protective apron and means for preventing water from passing through the barrier; and anchoring the apparatus generally perpendicular to a flow of water, whereby water is prevented from passing through the barrier and must reach a higher level to flow over the barrier.

20. The method of claim 19 further comprising:

providing the barrier with a 90° angle; and orienting the barrier relative to the apron such that the 90° angle is opposite an angled face of the barrier which confronts the water.

21. An apparatus for controlling water, sediment and soil erosion comprising:

a water-permeable foam barrier extending generally longitudinally, said barrier having an upstream surface and a downstream surface;

an apron extending laterally away from at least one of said surfaces of said barrier; and means for preventing fluid from passing through said barrier.

22. The apparatus of claim 21 wherein said means comprises a water-impermeable member disposed between said apron and said downstream surface.

23. An apparatus for controlling water, sediment and soil erosion comprising:

a water-permeable foam barrier extending generally longitudinally, said barrier having an upstream surface and a downstream surface;

an apron extending laterally away from at least one of said surfaces of said barrier; and means for reducing a height of said barrier to a lower elevation than a base portion of ends of said barrier such that the water flows over the apparatus at a predetermined location.

24. An apparatus for controlling water, sediment and soil erosion comprising:

a longitudinally extending barrier having an upstream surface and a downstream surface;

a protective apron disposed about said barrier, said protective apron having an approach apron portion extending in a lateral direction from said upstream surface and an exit apron portion extending in a lateral direction from said downstream surface;

a longitudinal attaching means for providing an axis about which said barrier is reconfigurable by rotating said barrier relative to said apron; and means for preventing fluid from passing through said barrier.

25. The apparatus of claim 24 wherein said means for preventing fluid comprises a water-impermeable member disposed between said apron and said downstream surface.

26. An apparatus for controlling water, sediment and soil erosion comprising:

a longitudinally extending barrier having an upstream surface and a downstream surface;

a protective apron disposed about said barrier, said protective apron having an approach apron portion extending in a lateral direction from said upstream surface and an exit apron portion extending in a lateral direction from said downstream surface;

a longitudinal attaching means for providing an axis about which said barrier is reconfigurable by rotating said barrier relative to said apron; and means for reducing a height of said barrier to a lower elevation than a base portion of ends of said barrier such that the water flows over a reduced height portion of said barrier rather than around an end of said barrier.

27. A method of controlling water, sediment and soil erosion comprising:

providing a reusable apparatus having an angled barrier and a protective apron;

anchoring the apparatus generally perpendicular to a natural flow of the water carrying the sediment, such that the water carrying the sediment is slowed, allowing sediment to be deposited upstream of the apparatus; and positioning the apparatus in an open drainage ditch such that a base portion of each end of the barrier is higher in elevation than a lowest point of an apex of the barrier, whereby the water will flow over the apex at a predetermined location rather than around the end of the barrier, thus preventing erosion around the ends of the barrier.

* * * * *